US006036303A

United States Patent [19]

Yamamoto et al.

[11] Patent Number: 6,036,303

[45] Date of Patent: Mar. 14, 2000

[54] INKJET RECORDING HEAD FOR REDUCING CROSSTALK

[75] Inventors: Koji Yamamoto, Takarazuka; Hideo Hotomi, Nishinomiya, both of Japan

[73] Assignee: Minolta Co., Ltd., Osaka, Japan

[21] Appl. No.: 09/008,364

[22] Filed: Jan. 16, 1998

[30] Foreign Application Priority Data

Jan. 20, 1997 [JP] Japan ..... 9-007416

[51] Int. Cl.[7] ..... B41J 2/045

[52] U.S. Cl. ..... 347/70; 347/71

[58] Field of Search ..... 347/70, 71

[56] References Cited

U.S. PATENT DOCUMENTS

| | | | |
|---|---|---|---|
| 4,369,455 | 1/1983 | McConica et al. | 346/140 R |
| 4,503,444 | 3/1985 | Tacklind | 346/140 R |
| 5,208,605 | 5/1993 | Drake | 346/1.1 |
| 5,327,627 | 7/1994 | Ochiai et al. | 347/71 X |
| 5,351,375 | 10/1994 | Ochiai et al. | 347/71 X |
| 5,412,410 | 5/1995 | Rezanka | 347/15 |
| 5,444,471 | 8/1995 | Usui et al. | 347/72 |
| 5,446,485 | 8/1995 | Usui et al. | 347/72 |
| 5,874,975 | 2/1999 | Hotomi et al. | 347/70 |
| 5,907,338 | 5/1999 | Burr et al. | 347/71 X |

FOREIGN PATENT DOCUMENTS

| | | |
|---|---|---|
| 0437062 | 7/1991 | European Pat. Off. . |
| 2282992 | 4/1995 | United Kingdom . |

*Primary Examiner*—William J. Royer
*Attorney, Agent, or Firm*—Sidley & Austin

[57] ABSTRACT

An inkjet recording head having a head main unit that includes a substrate, a vibration plate, a partition and a top plate, which are integrally assembled as a single unit, a first reinforcing plate fixed to the substrate, and a second reinforcing plate fixed to the top plate. The vibration plate is made of a piezoelectric material. The partition affixed to the vibration plate comprises a thin metal or synthetic resin film. The top plate affixed to the partition has multiple groove-shaped concave areas, which are used as ink cavities, on its surface facing the partition. The first reinforcing plate and the second reinforcing plate are fixed on either side of the head main unit and sandwich the head main unit for reinforcing the substrate and the top plate. Thus, when the piezoelectric members are deformed, accompanying deformation of neighboring piezoelectric members via the substrate or accompanying deformation of the top plate can be mostly prevented and crosstalk can be reduced to a level at which it does not negatively affect image quality.

20 Claims, 7 Drawing Sheets

Fig. 4

| | Material | Rate of Elasticity ($Kgf/mm^2$) | Thickness (mm) | Rate of Deformation (%) |
|---|---|---|---|---|
| Experiment 1 | Ceramic ($SiO_2$) | 5,000 | 1.9 | 2.8 |
| Experiment 2 | Vector Resin including TiO Filler | 670 | 15.0 | 1.3 |
| Experiment 3 | Stainless (SUS#304) | 17,000 | 0.8 | 2.0 |
| Experiment 4 | Ceramic ($SiO_2$) | 5,000 | 4.0 | 1.0 |
| Experiment 5 | Ceramic ($Al_2O_3$) | 6,200 | 3.5 | 0.4 |
| Experiment 6 | Ceramic (ZrO) | 7,800 | 4.0 | 0.3 |

INKJET RECORDING HEAD FOR REDUCING CROSSTALK

This application is based on application No. 9-7416 filed in Japan, the contents of which are hereby incorporated by reference.

BACKGROUND OF THE INVENTION

1. Field of the Invention

The present invention pertains to an inkjet recording head that records an image by causing ink drops to adhere to a recording medium such as recording paper.

2. Description of the Related Art

Inkjet recording heads have conventionally been proposed that are equipped with a substrate, multiple piezoelectric members mounted on said substrate, and a cavity-holding member that contains multiple ink cavities formed such that they face the piezoelectric members.

In an inkjet recording head of this type, a voltage is applied to prescribed piezoelectric members in accordance with an image signal so that they will deform, thereby pressurizing and expelling the ink inside the corresponding ink cavities.

However, in the inkjet recording head described above, depending on the pattern of voltage applied to the piezoelectric members, vibration caused by the deformation of the piezoelectric members is transmitted to neighboring piezoelectric members and ink cavities via the substrate and cavity-holding member, and causes the neighboring piezoelectric members and ink cavities to deform as well, resulting in a phenomenon in which ink drops are unintentionally expelled from other ink cavities, i.e., crosstalk. This crosstalk not only negatively affects image quality stability, but also leads to reduced ink expulsion efficiency because the force generated by the deformation of a piezoelectric member is not used for ink expulsion from only the corresponding ink cavity.

OBJECTS AND SUMMARY

The present invention was made to resolve the problems described above. Its object is to provide an improved inkjet recording head.

Another object of the present invention is to provide an inkjet recording head that provides high-quality recorded images.

Yet another object of the present invention is to provide an inkjet recording head in which crosstalk is reduced.

In order to attain these and other objects, an inkjet recording head of an embodiment comprises a head main unit equipped with a substrate, multiple piezoelectric members mounted on said substrate, and a cavity-holding member having multiple ink cavities that are formed such that they face said piezoelectric members, wherein a first reinforcing plate is fixed to said substrate and a second reinforcing plate is fixed to said cavity-holding member such that said first reinforcing plate and said second reinforcing plate sandwich the head main unit.

BRIEF DESCRIPTION OF THE DRAWINGS

These and other objects and features of the present invention will become apparent from the following description of a preferred embodiment thereof taken in conjunction with the accompanying drawings, in which:

FIG. 4 is a table showing the results of an evaluation regarding the piezoelectric member deformation rate and image quality when the type and thickness of the reinforcing plates fixed to the substrate and top plate are varied.

In the following description, like parts are designated by like reference numbers throughout the several drawings.

DETAILED DESCRIPTION OF THE PREFERRED EMBODIMENT

The inkjet recording heads pertaining to the embodiments of the present invention are explained below with reference to the accompanying drawings.

Figure 1:
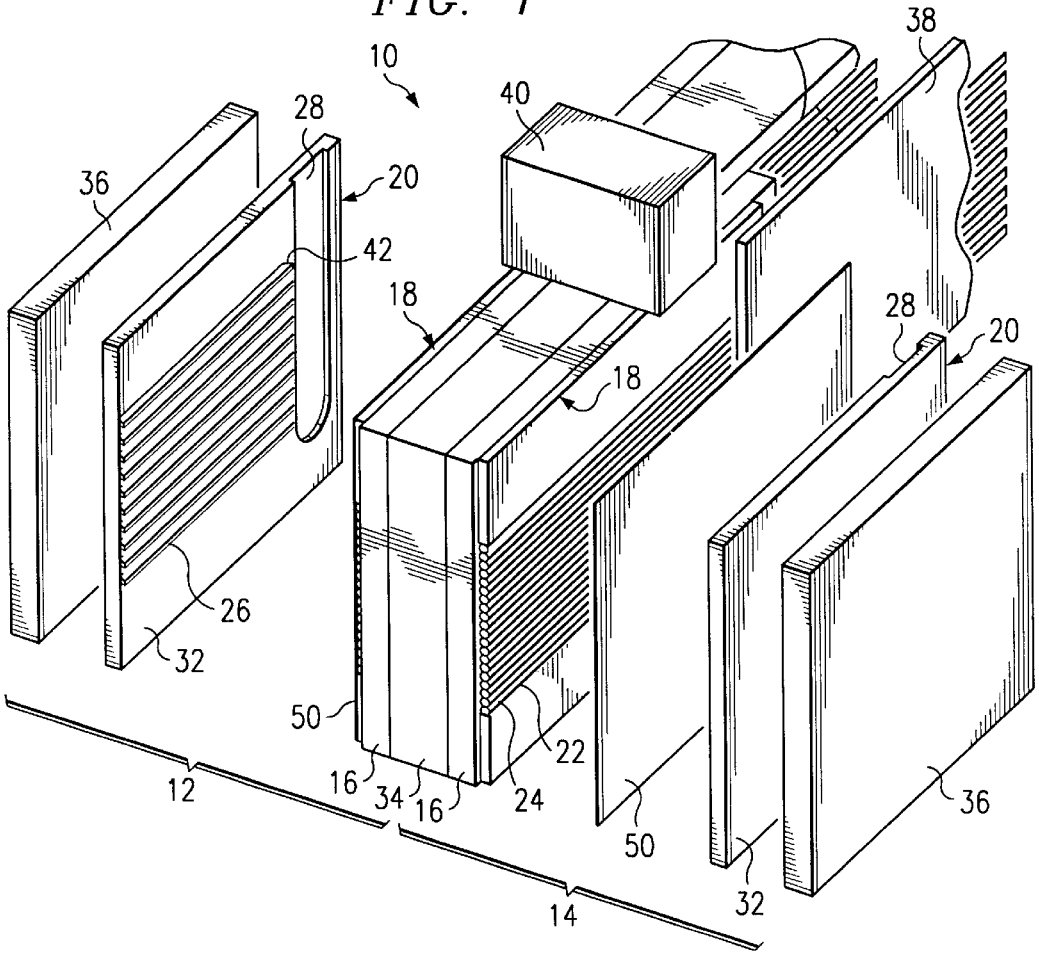
FIG. 1 is an exploded perspective view of an inkjet recording head.

FIG. 1 is an exploded perspective view of head assembly 10 comprising inkjet recording heads 12 and 14, one embodiment of the present invention, which are integrally mounted on either side of first reinforcing plate 34. Since inkjet recording heads 12 and 14 share essentially the same construction and differ from each other only in terms of the color of the ink expelled or the size of the ink drops expelled, the same numbers are given to identical members and explanations will not be repeated.

Figure 2:
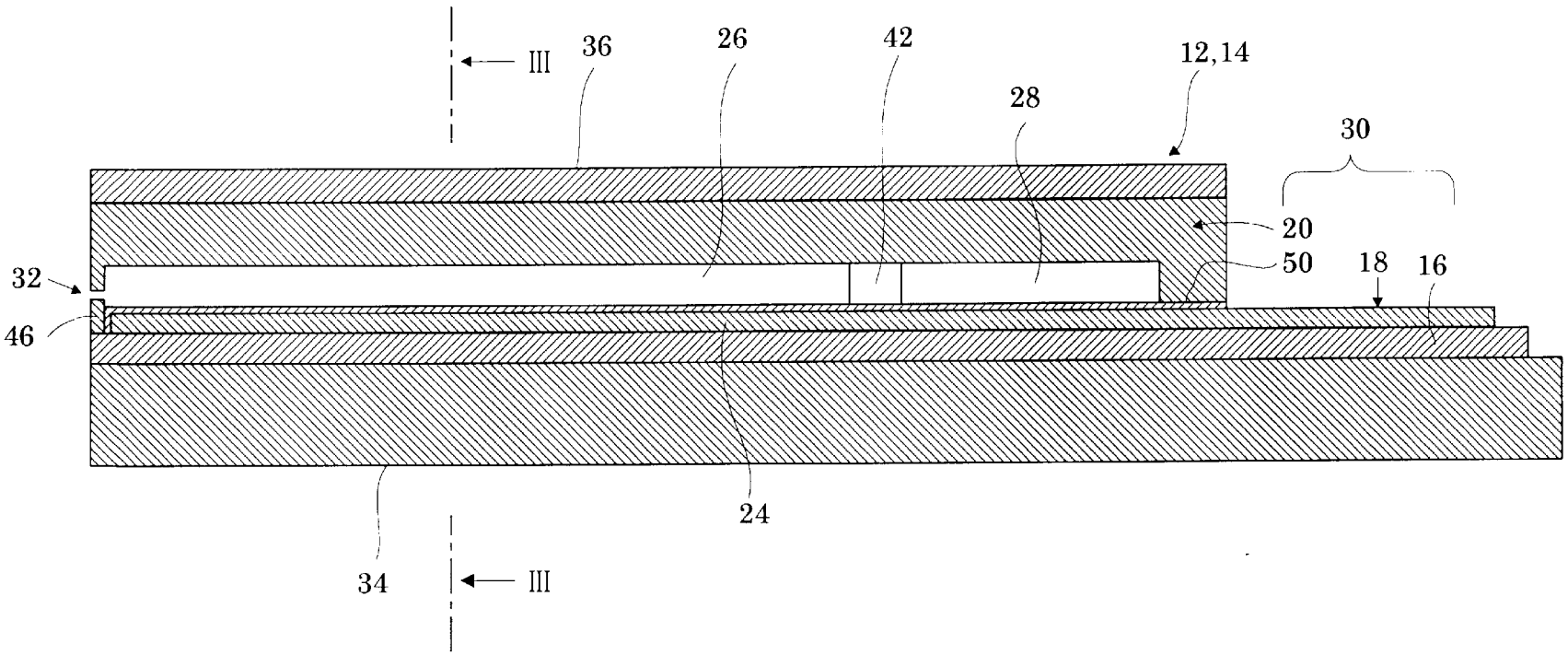
FIG. 2 is a longitudinal sectional view of the ink cavity and piezoelectric member, which are cut along their lengths.
Figure 3:
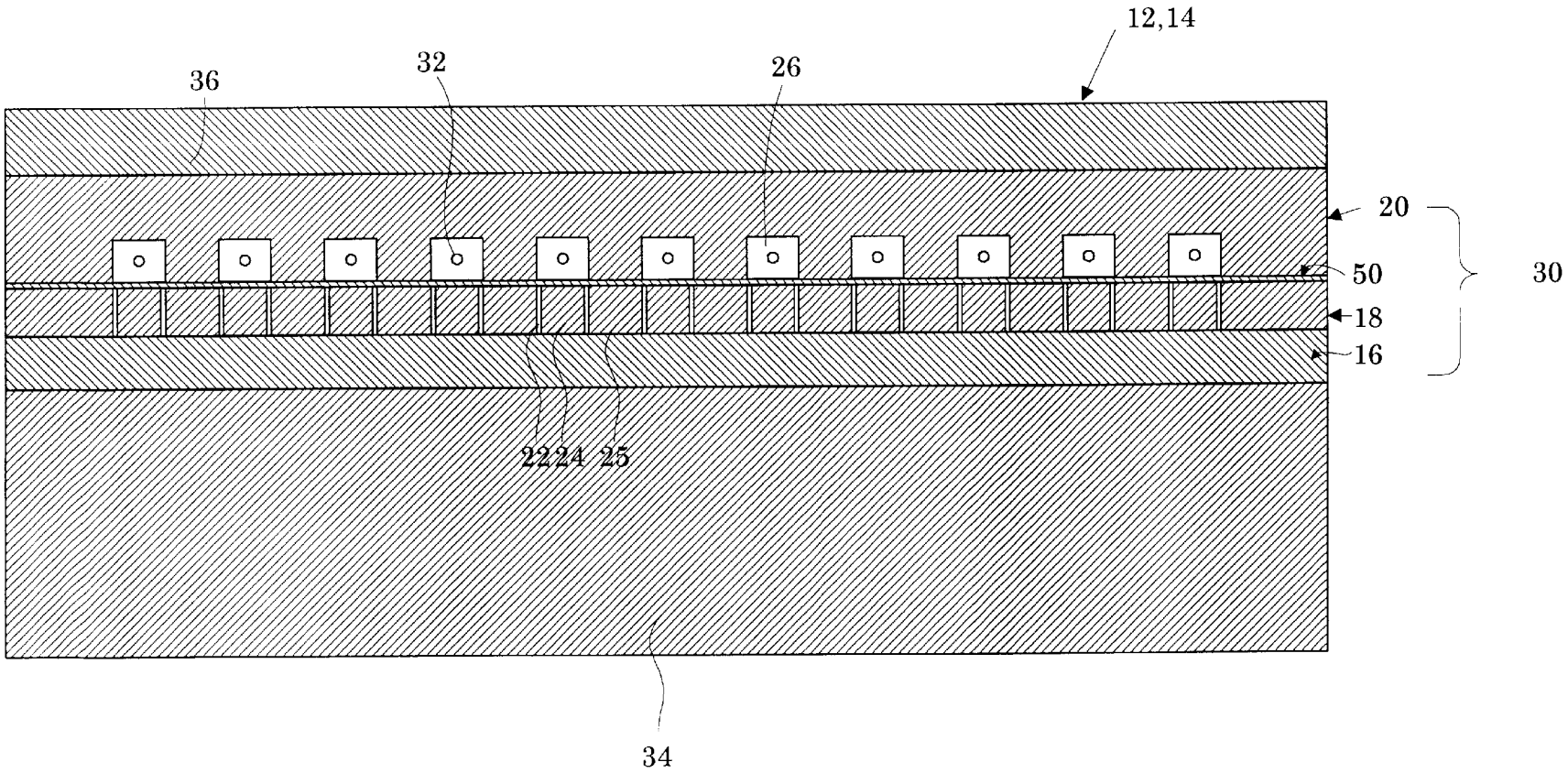
FIG. 3 is a cross-sectional view of the head of FIG. 2 cut along the III—III line.
Figure 5:
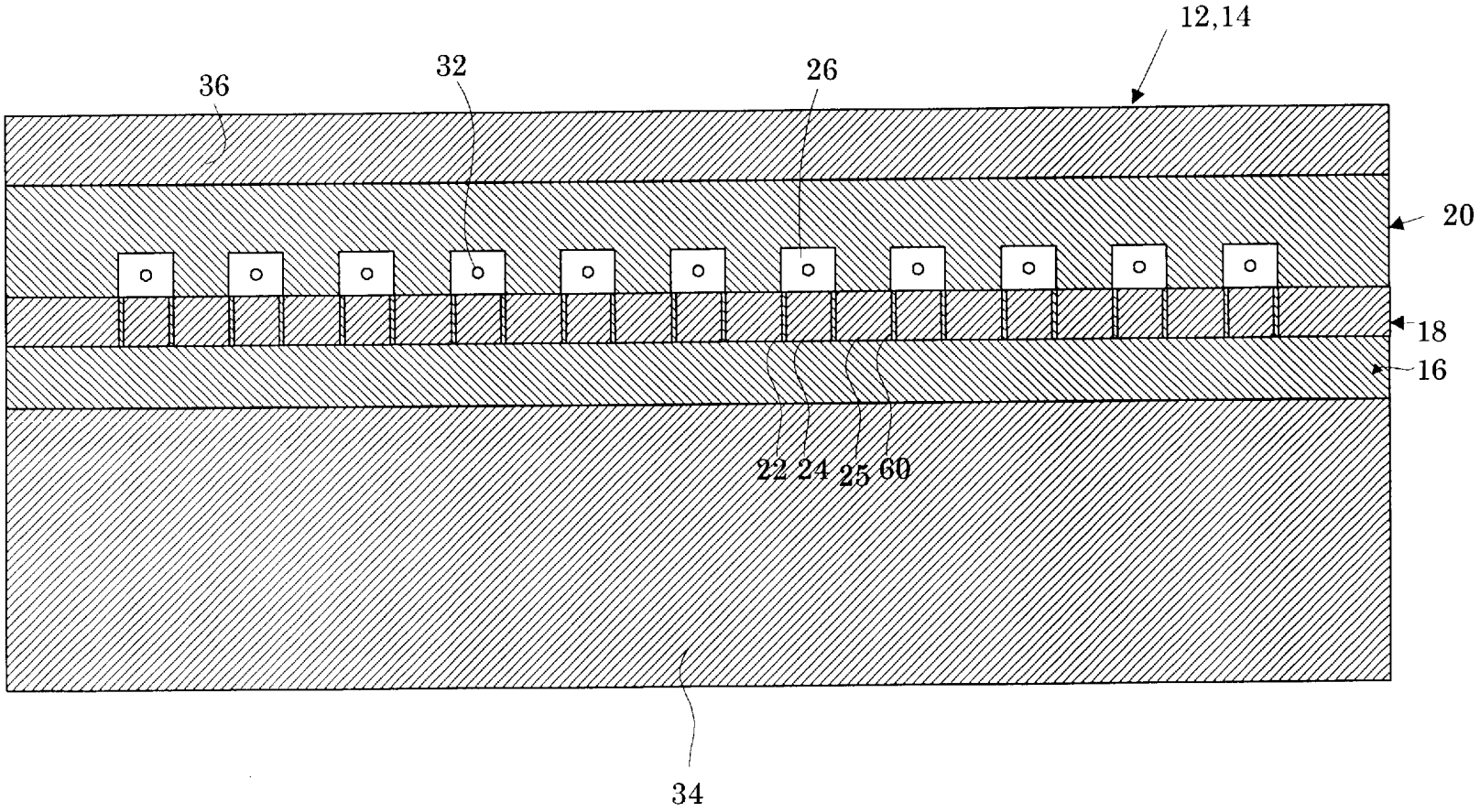
FIG. 5 is a transverse sectional view of an inkjet recording head pertaining to a second embodiment.

Inkjet recording heads 12 and 14 each comprise head main unit 30 that includes substrate 16, vibration plate 18, partition 50 and top plate (cavity-holding member) 20, which are integrally assembled as a single unit, first reinforcing plate 34 fixed to substrate 16, and second reinforcing plate 36 fixed to top plate 20, as shown in FIG. 1 or FIGS. 2 and 3 that respectively show longitudinal and transverse sectional views of the head.

Substrate 16 is made of a ceramic, metal or synthetic resin material. Vibration plate 18 affixed to substrate 16 is made of a public-domain piezoelectric material and is equipped with electrode layers (not shown in the drawing) at the top and bottom. Multiple parallel slits 22 are formed in vibration plate 18 at prescribed intervals along the length of the plate, and the areas between adjacent slits alternately function as piezoelectric members 24 and as partition walls 25. Piezoelectric members 24 are polarized by applying a high voltage between the top and bottom electrode layers under high temperature.

Partition 50 affixed to vibration plate 18 comprises a thin metal or synthetic resin film. Top plate 20 affixed to partition 50 is made of ceramic, metal or synthetic resin, and multiple groove-shaped concave areas are formed via microprocessing on its surface facing partition 50. When these concave areas are covered with partition 50, top plate 20 forms multiple ink cavities 26 that face piezoelectric members 24. Ink supply chamber 28 that houses replenishing ink is connected to these ink cavities 26 via ink inlets 42. One end of ink supply chamber 28 is connected to ink distributor 40 that is connected to an ink tank not shown in the drawing, such that ink supplied to ink supply chamber 28 from the ink tank via ink distributor 40 is supplied to ink cavities 26 via ink inlets 42.

Multiple nozzles 32 that are connected to ink cavities 26 are formed via laser processing at equal intervals along a straight line at one end of top plate 20. In other words, inkjet recording heads 12 and 14 of this embodiment are so-called edge expulsion-type heads in which the direction in which the surfaces of piezoelectric members 24 facing the ink cavities extend during voltage application and the direction of ink expulsion are perpendicular to each other. Inkjet recording heads 12 and 14 may be formed to be the same or different in size.

As shown in FIG. 2, the end of vibration plate 18 on the side of nozzles 32 is covered with cover 46. The length of vibration plate 18 along the length of ink cavities 26 is longer than that of top plate 20. Piezoelectric members 24 and substrate 16 protrude from top plate 20 on the side opposite the side on which nozzles 32 are located. The electrodes on one surface of piezoelectric members 24 are grounded at this protruding area while the electrodes on the other surface are individually connected to the image signal control circuit via flexible wiring 38 (see FIG. 1).

First reinforcing plate 34 and second reinforcing plate 36 that are fixed on either side of head main unit 30 having the construction described above each comprise a ceramic, metal or synthetic resin flat plate and are essentially the same size as substrate 16 or top plate 20. First and second reinforcing plates 34 and 36 are fixed via adhesive layers (not shown in the drawing) to substrate 16 and top plate 20, respectively. It is preferred that the thickness of the adhesive layer be approximately 1 m to 20 $\mu$m. If the adhesive layers are thicker than this range, the reinforcing plates could not achieve their function to prevent accompanying deformation of substrate 16 and top plate 20 due to the elasticity of the adhesive layers.

In inkjet recording heads 12 and 14 having the construction described above, when a voltage is applied between the top and bottom electrodes from the image signal control circuit, piezoelectric members 24 instantly deform and push partition 50 toward ink cavities 26. Ink that is pressurized by said action is then expelled as ink drops through nozzles 32. By repeating this operation onto the recording medium while scanning it, an image is recorded by the dots that are formed by the ink drops adhering to the recording medium.

In inkjet recording heads 12 and 14, because substrate 16 and top plate 20 are reinforced by first reinforcing plate 34 and second reinforcing plate 36, respectively, when prescribed piezoelectric members 24 are deformed, accompanying deformation of neighboring piezoelectric members 24 via substrate 16 or accompanying deformation of top plate 20 can be mostly prevented and crosstalk can be reduced to a level at which it does not negatively affect image quality. Therefore, image quality may be stabilized without the unnecessary expulsion of ink caused by crosstalk. In addition, since the force generated when piezoelectric members 24 become deformed can be reliably used to expel ink from their corresponding ink cavities, ink expulsion efficiency increases.

Inkjet recording heads 12 and 14 are of the edge-expulsion type and have a small area for the surface on which the nozzles are formed, which is the surface that faces the recording medium. Therefore, the dead space on the recording medium may be reduced and the range in which printing may be performed increases. For the same reason, the space required for the heads to retract into may be small as well, which is advantageous in making the apparatus small. These effects are particularly marked when full-color images are formed by using two head assemblies 10 side by side, each having two heads, and by supplying inks of different colors to the four heads.

The degree of accompanying deformation of the piezoelectric members and the state of ink expulsion were evaluated for inkjet recording heads 12 and 14 by changing the type and thickness of the reinforcing plates. The types, rates of elasticity, and thicknesses of the reinforcing plates and the rates of deformation used for the measurement are shown in the table in FIG. 4. The rate of deformation is a value obtained by dividing the amount of accompanying deformation ($\delta 2$) of a specific piezoelectric member when all the other piezoelectric members other than said specific piezoelectric member are operated, by the amount of deformation of the specific piezoelectric member ($\delta 1$) when it is operated but all the other piezoelectric members are not operated ($\delta 2/\delta 1$). In this experiment, multiple-layer type piezoelectric material comprising fifteen 35 $\mu$m piezoelectric layers stacked together was used for the piezoelectric members. The first and the second reinforcing plates 34 and 36 comprised plates made of the same material and having the same thickness. The reinforcing plates were affixed to the substrate and top plate, respectively, using an epoxy resin adhesive material (AZ-15, Ciba-Geigy, rate of elasticity= 260 kgf/mm2), and the thickness of the adhesive layer was 3 $\mu$m. The voltage applied to the piezoelectric members was 30 V and had a pulse width of 15 $\mu$sec.

If the rate of deformation is 5% or less, an image with little crosstalk effect may be obtained. Based on the results shown in the table, it was confirmed that the rate of deformation could be made substantially smaller than 5% for all of experiment examples 1 through 6. It can be seen from this that crosstalk can be essentially completely prevented. In fact, in these experiment examples, good images having no ink expulsion caused by crosstalk were obtained.

As a result of a control experiment in which the same conditions as the above experiment were used but a reinforcing plate was fixed to the substrate only, it was found that the rate of deformation more than doubled in each case. There were also cases where ink expulsion was caused by crosstalk.

In inkjet recording heads 12 and 14 of this embodiment explained above, piezoelectric members 24 face ink cavities 26 via partition 50. It is also acceptable, however, if piezoelectric members 24 directly face ink cavities 26 without the partition in between. In this case, filler 60 made of a resin material, for example, should be filled in slits 22 between piezoelectric members 24 and partition walls 25 to prevent ink leakage. In addition, it is preferred that an ink-repellent coating be applied to the surfaces of piezoelectric members 24 that come into contact with ink.

Figure 6:
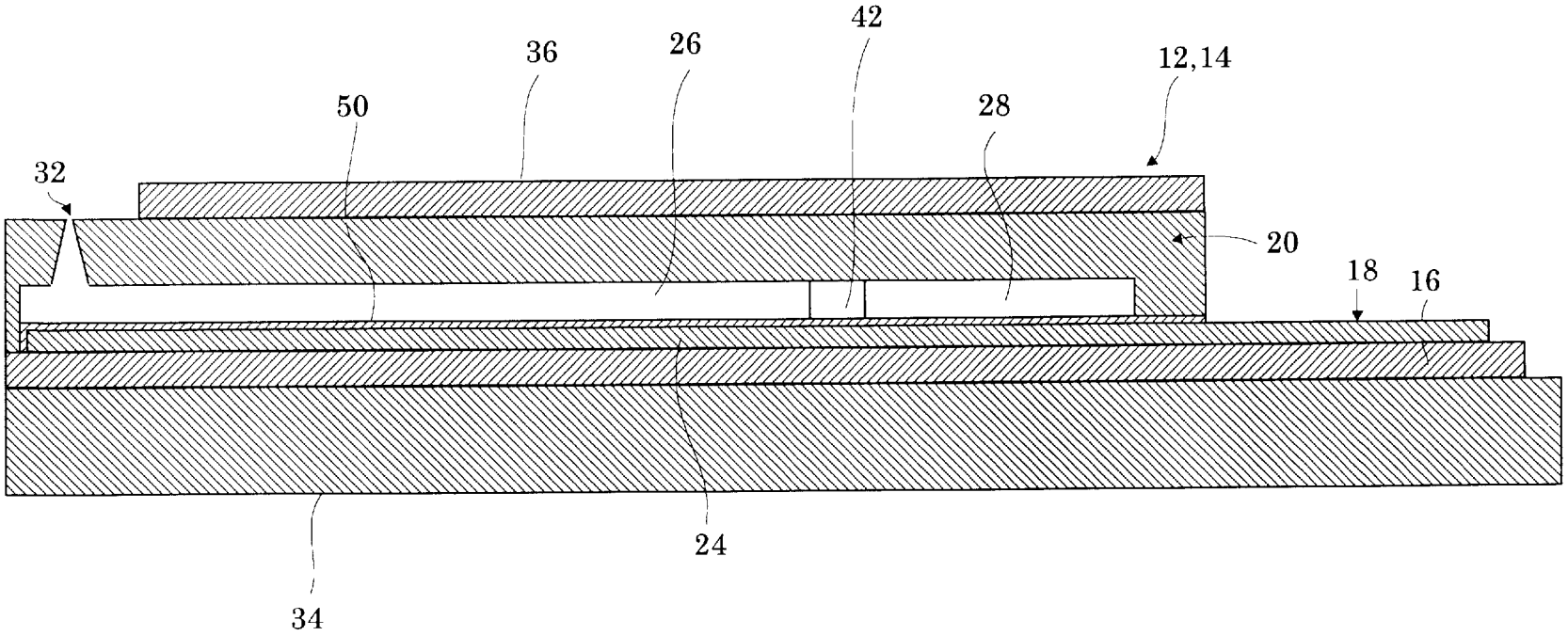
FIG. 6 is a longitudinal sectional view of an inkjet recording head pertaining to a third embodiment.

Further, while inkjet recording heads 12 and 14 are of the edge-expulsion type, the present invention may be applied to a head in which, during the application of voltage, the direction of deformation of the surface of the piezoelectric member facing the ink cavity and the direction of ink expulsion are the same, i.e., a head of the surface-expulsion type. In this case, nozzle 32 that connects to ink cavity 26 is formed near one end of the ink cavity such that the nozzle opens up toward the upper surface of top plate 20, as shown in FIG. 6, and the length of second reinforcing plate 36 is made slightly shorter than top plate 20 so that nozzles 32 will not be closed off.

Figure 7:
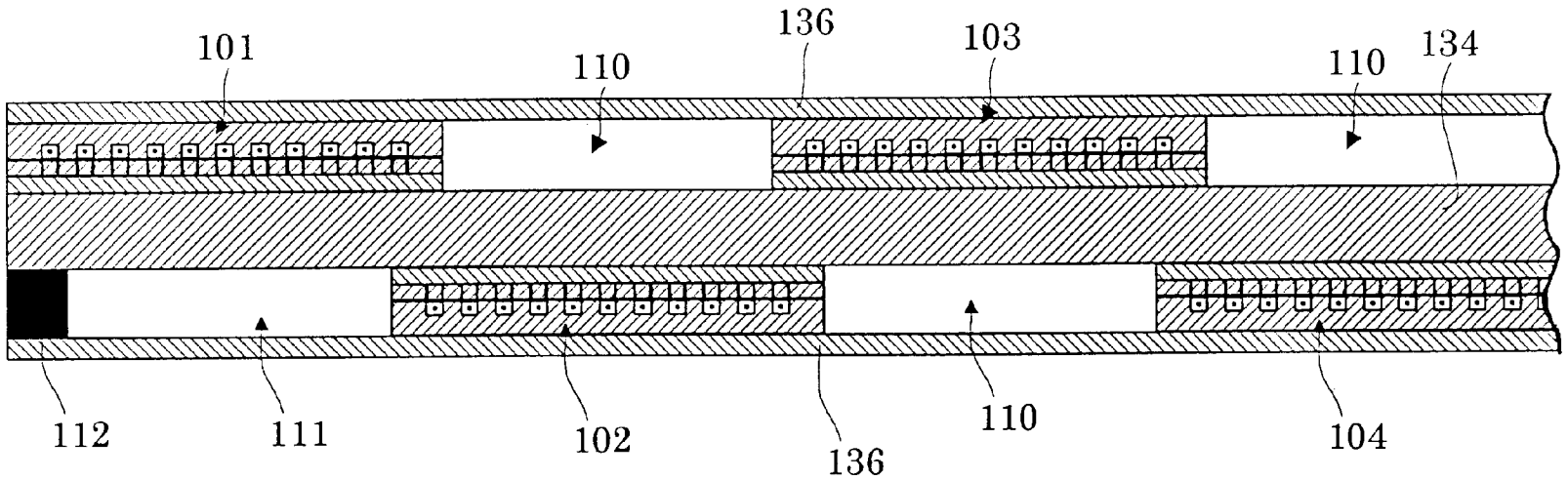
FIG. 7 is a longitudinal sectional view of an inkjet recording head pertaining to a fourth embodiment.

FIG. 7 shows the present invention applied in a long recording head assembly that has the same length as the width of the recording paper. As shown in FIG. 7, multiple recording heads 101, 102, 103, 104, . . . are mounted on both sides of first reinforcing plate 134 such that they are offset from one another along the length of the reinforcing plate.

They are then sandwiched by two second reinforcing plates 136 which are affixed to the recording heads. Recording heads 101, 102, 103, 104, . . . each have ten nozzles. Recording heads 102, 103, 104, . . . are alternately mounted such that their nozzles are aligned at equal intervals along the length of the reinforcing plate. This makes the manufacturing of a long recording head assembly easy. Spaces 110 formed between recording heads and space 111 formed between spacer 112 and head 102 are used as ink supply chambers in which ink is housed and ink is supplied from these chambers to the cavities for each head.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An inkjet recording head comprising:

a first head main unit equipped with a first substrate, a first plurality of piezoelectric members mounted on said first substrate, and a first cavity-holding member having a first plurality of ink cavities which face said first plurality of piezoelectric members;

a first reinforcing plate having a first side which is fixed to a first surface of said first head main unit; and a second reinforcing plate having a first side which is fixed to a second surface of said first head main unit, said first surface of said first head main unit being opposite to said second surface of said first head main unit;

wherein said first head main unit is sandwiched by and between said first reinforcing plate and said second reinforcing plate.

2. An inkjet recording head as claimed in claim 1, further comprising:

a second head main unit equipped with a second substrate, a second plurality of piezoelectric members mounted on said second substrate, and a second cavity-holding member having a second plurality of ink cavities which face said second plurality of piezoelectric members, a first surface of said second head main unit being fixed to a second side of said first reinforcing plate, said second side of said first reinforcing plate being opposite to said first side of said first reinforcing plate; and a third reinforcing plate having a first surface which is fixed to a second surface of said second head main unit, said second surface of said second main head unit being opposite to said first surface of said second head main unit;

wherein said second head main unit is sandwiched by and between said first reinforcing plate and said third reinforcing plate.

3. An inkjet recording head as claimed in claim 2, wherein each of said first reinforcing plate and said third reinforcing plate is made of ceramic.

4. An inkjet recording head as claimed in claim 2, wherein each of said first reinforcing plate and said third reinforcing plate is made of stainless steel.

5. An inkjet recording head as claimed in claim 2, wherein each of said first reinforcing plate and said third reinforcing plate is made of resin material.

6. An inkjet recording head as claimed in claim 1, wherein each of said first reinforcing plate and said second reinforcing plate is made of ceramic.

7. An inkjet recording head as claimed in claim 1, wherein each of said first reinforcing plate and said second reinforcing plate is made of stainless steel.

8. An inkjet recording head as claimed in claim 1, wherein each of said first reinforcing plate and said second reinforcing plate is made of resin material.

9. An inkjet recording head comprising:

a first head main unit which is made by stacking a substrate, a vibration plate, a partition, and a top plate, said vibration plate having a piezoelectric member, and said top plate having an ink cavity which faces said piezoelectric member through said partition;

a first reinforcing plate which is fixed to said substrate; and a second reinforcing plate which is fixed to said top plate;

wherein said first head main unit is sandwiched by and between said first reinforcing plate and said second reinforcing plate.

10. An inkjet recording head as claimed in claim 9, further comprising:

a second head main unit having a structure which is the same as said first head main unit; and a third reinforcing plate which is fixed to said second head main unit;

wherein said second head main unit is sandwiched by and between said first reinforcing plate and said third reinforcing plate.

11. An inkjet recording head as claimed in claim 10, wherein each of said first reinforcing plate and said third reinforcing plate is made of ceramic.

12. An inkjet recording head as claimed in claim 10, wherein each of said first reinforcing plate and said third reinforcing plate is made of stainless steel.

13. An inkjet recording head as claimed in claim 10, wherein each of said first reinforcing plate and said third reinforcing plate is made of resin material.

14. An inkjet recording head as claimed in claim 9, wherein each of said first reinforcing plate and said second reinforcing plate is made of ceramic.

15. An inkjet recording head as claimed in claim 9, wherein each of said first reinforcing plate and said second reinforcing plate is made of stainless steel.

16. An inkjet recording head as claimed in claim 9, wherein each of said first reinforcing plate and said second reinforcing plate is made of resin material.

17. An inkjet recording head comprising:

a plurality of head main units which include a plurality of nozzles for ejecting ink droplets, said plurality of nozzles being arranged linearly;

a first plate which holds said plurality of head main units alternately on both surfaces thereof such that said plurality of head main units are offset from one another in a longitudinal direction of the first plate, wherein said plurality of nozzles of said plurality of head main units are aligned at equal intervals in the longitudinal direction of the first plate; and wherein said plurality of head main units fixed on the first plate are sandwiched by and between a second plate and a third plate.

18. An inkjet recording head as claimed in claim 17, wherein spaces are formed between said plurality of head main units for use as ink supply chambers.

19. An inkjet recording head as claimed in claim 17, wherein each of said plurality of head main units has the same structure.

20. An inkjet recording head as claimed in claim 19, wherein each of said plurality of head main units held on the first plate is equipped with a substrate, a plurality of piezoelectric members mounted on said substrate, and a cavity-holding member having a plurality of ink cavities which face said plurality of piezoelectric members.

* * * * *